US009657615B2

(12) United States Patent
Nakano et al.

(10) Patent No.: US 9,657,615 B2
(45) Date of Patent: May 23, 2017

(54) SILENCER FOR INTERNAL COMBUSTION ENGINE

(71) Applicant: HONDA MOTOR CO., LTD., Tokyo (JP)

(72) Inventors: Junichi Nakano, Wako (JP); Shin Nishimura, Wako (JP); Yoshitaka Hayama, Wako (JP); Masashi Koyanagi, Wako (JP); Yohei Yajima, Wako (JP); Takahiko Shimizu, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/068,757

(22) Filed: Mar. 14, 2016

(65) Prior Publication Data

US 2016/0281557 A1 Sep. 29, 2016

(30) Foreign Application Priority Data

Mar. 26, 2015 (JP) ..... 2015-063564

(51) Int. Cl.

| | |
|---|---|
| ***F01N 1/02*** | (2006.01) |
| ***F01N 13/18*** | (2010.01) |
| ***F01N 1/00*** | (2006.01) |
| ***F01N 1/08*** | (2006.01) |
| ***F01N 1/16*** | (2006.01) |

(52) U.S. Cl.

CPC ..... *F01N 1/02* (2013.01); *F01N 1/003* (2013.01); *F01N 1/006* (2013.01); *F01N 1/026* (2013.01); *F01N 1/08* (2013.01); *F01N 1/085* (2013.01); *F01N 1/089* (2013.01); *F01N 1/165* (2013.01); *F01N 13/1866* (2013.01); *F01N 2210/04* (2013.01); *F01N 2470/02* (2013.01); *F01N 2490/02* (2013.01); *F01N 2490/04* (2013.01); *F01N 2490/08* (2013.01);

(Continued)

(58) Field of Classification Search

CPC ..... F01N 1/02; F01N 1/165
USPC ..... 181/268
See application file for complete search history.

(56) References Cited

U.S. PATENT DOCUMENTS 4,192,403 A * 3/1980 Nakagawa ..... F01N 1/089 181/268
8,469,142 B2 * 6/2013 Feng ..... F01N 1/085 181/254

(Continued)

FOREIGN PATENT DOCUMENTS

JP 09-096217 A 4/1997

*Primary Examiner* — Forrest M Phillips
(74) *Attorney, Agent, or Firm* — Squire Patton Boggs (US) LLP

(57) ABSTRACT

A silencer includes conduit with a downstream end portion configured from a tubular member which includes a conduit discharge port extending through a silencer main body and discharges exhaust gas to the outside therethrough. The tubular member includes a resonance communication hole communicating with a resonance chamber and an upstream side communication hole and a downstream side communication hole communicating with a second chamber. A barrier wall serving as a throttle portion for throttling an exhaust path at an intermediate location of the tubular member is provided in the inside of the tubular member and between the upstream side communication hole and the downstream side communication hole.

7 Claims, 12 Drawing Sheets

(52) U.S. Cl.
CPC .... *F01N 2490/15* (2013.01); *F01N 2490/155* (2013.01); *F01N 2590/04* (2013.01)

(56) References Cited

U.S. PATENT DOCUMENTS

| | | | | |
|---|---|---|---|---|
| 2002/0033302 | A1* | 3/2002 | Kaneko | F01N 1/089 181/232 |
| 2002/0033303 | A1* | 3/2002 | Nagai | F01N 1/165 181/237 |
| 2005/0189166 | A1* | 9/2005 | Kikuchi | F01N 1/089 181/237 |
| 2006/0027420 | A1* | 2/2006 | Hahnl | F01N 1/165 181/283 |
| 2006/0162995 | A1* | 7/2006 | Schorn | F01N 1/006 181/237 |
| 2013/0270034 | A1* | 10/2013 | Wakatsuki | F01N 1/02 181/268 |

* cited by examiner

SILENCER FOR INTERNAL COMBUSTION ENGINE

BACKGROUND

Field

The present invention relates to a silencer wherein the inside of an outer tube is partitioned by two partition walls such that a first chamber, a resonance chamber and a second chamber are provided in order from the upstream side.

Description of the Related Art

A silencer is conventionally known which is structured such that it includes a first chamber connected to an exhaust pipe, a second chamber to which a discharge pipe for discharging exhaust gas to the outside of the silencer and a resonance chamber provided between the first and second chambers (refer, for example, to Japanese Patent Laid-Open No. Hei 9-96217 (Patent Document 1)). In the silencer, a conduit is communicated with the first chamber, resonance chamber and second chamber.

In such a motorcycle as disclosed in Patent Document 1, since the vehicle body has a limited space which can be utilized, it is demanded for the silencer to be small in length and sectional area while a good silencing performance is assured.

SUMMARY

It is an object of the present invention to provide a silencer which can be improved in silencing performance while it achieves downscaling and reduced size.

In order to achieve the object described above, according to an embodiment of the present invention, there is provided a silencer including a main body including an outer tube closed at front and rear ends thereof. An exhaust connection tube to which an exhaust pipe extends from an engine side and is connected and a discharge pipe which discharges exhaust gas to the outside therethrough are connected. A first partition wall and a second partition wall are provided in order from the upstream side in the main body such that the inside of the main body is partitioned into a first chamber and a resonance chamber by the first partition wall. The inside of the main body is also partitioned into the resonance chamber and a second chamber by the second partition wall. A conduit is supported on the first partition wall and the second partition wall. The conduit has a downstream end portion configured from a tubular member including a conduit discharge port which extends through the main body and discharges exhaust gas to the outside. The tubular member includes a resonance communication hole which communicates with the resonance chamber, and an upstream side communication hole and a downstream side communication hole which communicate with the second chamber. A closing portion closes an exhaust path at an intermediate location of the tubular member, or a throttle portion which throttles the exhaust path is provided between the upstream side communication hole and the downstream side communication hole in the inside of the tubular member.

The silencer may be configured such that the resonance communication hole is disposed on the upstream side of the resonance chamber.

The silencer may be configured such that at least part of a circumferential wall of the outer tube which defines the resonance chamber is configured linearly in a longitudinal direction, and a portion of the conduit in the resonance chamber is configured linearly in a longitudinal direction.

The silencer may be configured such that the throttle portion is a vertical wall welded in the conduit and has an opening of a small diameter.

The silencer may be configured such that the throttle portion is a pipe member which communicates and connects an upstream conduit which includes the upstream side communication hole and a downstream conduit which includes the downstream side communication hole to each other.

Further, the silencer may be configured such that a resonance chamber inlet tube attached to the first partition wall in order to introduce exhaust gas from the first chamber into the resonance chamber is disposed on the downstream side of the exhaust connection tube, and the resonance chamber inlet tube overlaps with the exhaust connection tube as viewed from a direction of an axial line of the exhaust connection tube.

The silencer may be configured such that the discharge pipe includes a closing member provided thereon which closes a front end portion of the discharge pipe disposed in the second chamber, and has a discharge pipe communication hole perforated therein which communicates the second chamber and the inside of the discharge pipe with each other.

The conduit of the present invention has the downstream end portion configured from the tubular member including the conduit discharge port which extends through the main body, and discharges exhaust gas to the outside therethrough. The tubular member includes the resonance communication hole which communicates with the resonance chamber, and the upstream side communication hole and the downstream side communication hole which communicate with the second chamber. Further, the closing portion which closes the exhaust path at an intermediate portion of the tubular member, or the throttle portion which throttles the exhaust path, is provided in the inside of the tubular member and between the upstream side communication hole and the downstream side communication hole. Therefore, since the conduit is disposed over a distance from the resonance chamber on the upstream side to the second chamber, the conduit can be formed to be relatively long and the attenuation characteristic of the exhaust sound can be improved. Further, since the closing portion or the throttle portion is provided in the second chamber, the pressure in the conduit can be raised so that exhaust gas flows with certainty into the resonance chamber and the second chamber through the resonance communication hole and the upstream side communication hole. This can improve the attenuation characteristic of exhaust sound. Further, since the conduit is supported by the first partition wall and the second partition wall and is disposed over a distance from the first chamber to the second chamber, even if the second chamber is structured such that the temperature therein is likely to become high, heat in the first chamber given from a high exhaust temperature is less likely to reach the second chamber by the resonance chamber. Therefore, the temperature of the second chamber can be maintained low and thermal energy which exhaust gas has is discharged, and the silencing performance can be improved. Further, by providing not only the discharge pipe but also the conduit discharge port in order to discharge exhaust gas to the outside, the exhaust resistance can be decreased low. Consequently, the engine output power can be enhanced and the length and the cross sectional area of the silencer can be decreased to achieve a reduced size of the silencer.

Since the resonance communication hole is disposed on the upstream side of the resonance chamber, it is possible to increase the distance between the resonance communication hole and the closing portion or the throttle portion, to increase the distance by which the exhaust sound bouncing off the closing portion or the throttle portion reaches the resonance chamber to fold back the elongated pipe to achieve a good attenuation characteristic of the exhaust sound.

The outer tube is formed, at least at part of the circumferential wall thereof which forms the resonance chamber, in a linear shape in the longitudinal direction. The conduit is formed, at a portion thereof in the resonance chamber, in a linear shape in the longitudinal direction. Therefore, the distance between the conduit in the resonance chamber and the circumferential wall of the resonance chamber can be made fixed thereby to suppress dispersion in frequency of the exhaust sound to be attenuated.

The throttle portion is a vertical wall welded in the conduit and has the opening of a small diameter. Therefore, since the throttle portion and the conduit are formed as separate members, it is possible to adjust, by preparing a plurality of throttle portions having openings of different areas from each other, the sound characteristics (magnitude, pitch and tone) of the exhaust sound.

The throttle portion is a pipe member which communicates and connects the upstream conduit which includes the upstream side communication hole and the downstream conduit which includes the downstream side communication hole to each other. Therefore, since the upstream conduit and the downstream conduit are connected to each other, exhaust gas to flow to the downstream side is rectified by the pipe member and does not disturb the exhaust gas flowing out from the downstream side communication hole.

The resonance chamber inlet tube attached to the first partition wall in order to introduce exhaust gas from the first chamber into the resonance chamber is disposed on the downstream side of the exhaust connection tube. The resonance chamber inlet tube overlaps with the exhaust connection tube as viewed from a direction of the axial line of the exhaust connection tube. Therefore, exhaust gas is liable to flow from the exhaust connection pipe into the resonance chamber through the resonance chamber inlet tube, and it is possible to raise the resonance effect to improve the attenuation characteristic of exhaust sound.

The discharge pipe includes the closing member which closes the front end portion of the discharge pipe disposed in the second chamber, and has the discharge pipe communication hole perforated therein which communicates the second chamber and the inside of the discharge pipe with each other. Therefore, since exhaust gas flows from the second chamber into the discharge pipe through the discharge pipe communication hole, the attenuation characteristic of the exhaust sound can be improved.

BRIEF DESCRIPTION OF THE DRAWINGS

FIGS. 6(A) and 6(B) illustrate a second chamber and peripheral elements of the right side silencer, and wherein FIG. 6(A) is a sectional view taken along a conduit, and FIG. 6(B) is a sectional view taken along an exhaust pipe.

DETAILED DESCRIPTION

Figure 1:
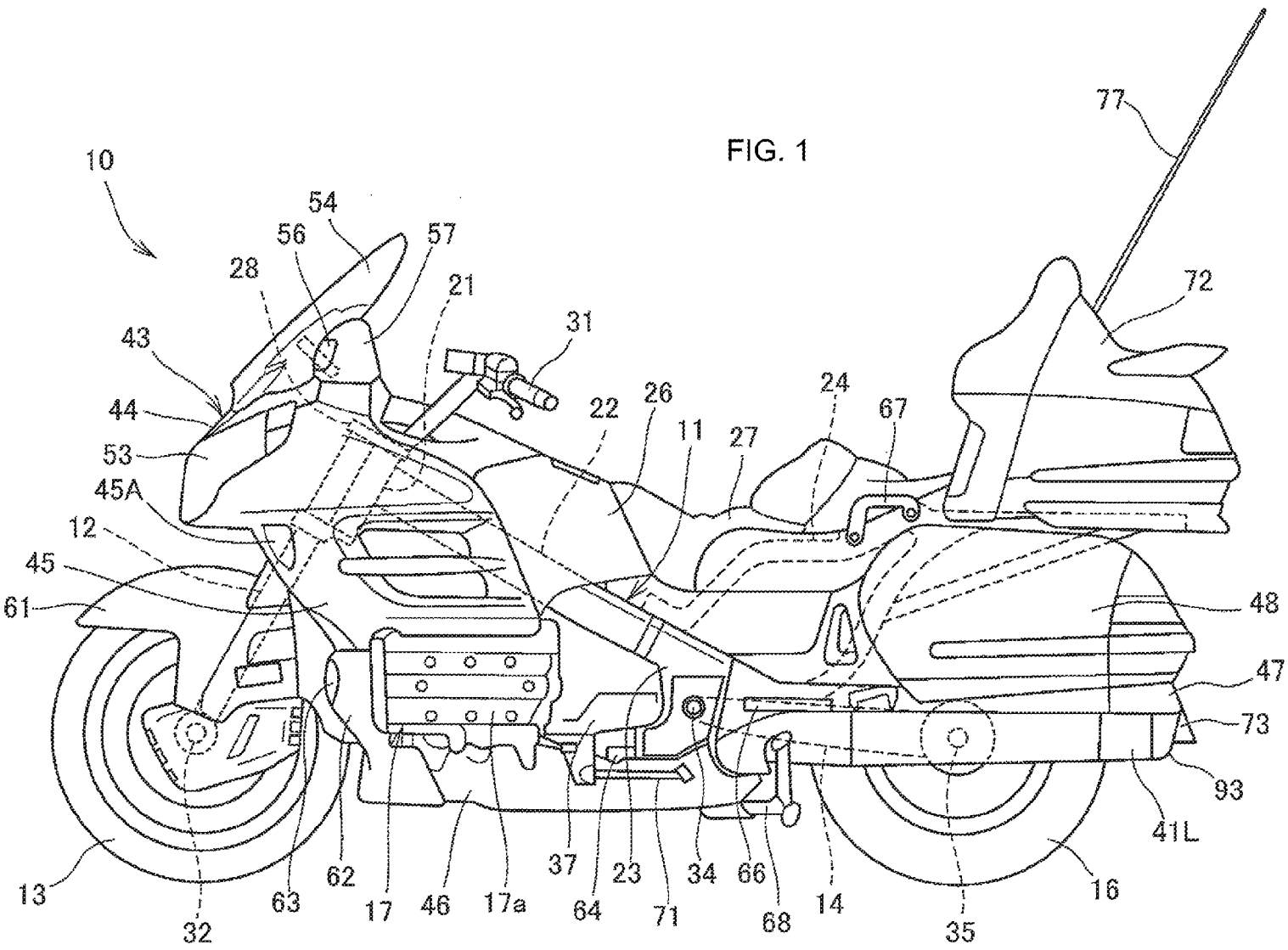
FIG. 1 is a left side elevational view illustrating a motorcycle which includes a silencer according to a first embodiment of the present invention.

In the following, embodiments of the present invention are described with reference to the drawings. It is to be noted that, unless otherwise specified, representations of directions such as forward and rearward, leftward and rightward, and upward and downward directions coincide with directions as viewed from a vehicle body. Further, in the drawings, reference character FR indicates the vehicle body forward direction; UP the vehicle body upward direction; and LH the vehicle body leftward direction.

FIG. 1 is a left side elevational view illustrating a motorcycle 10 which includes silencers 41L and 41R according to a first embodiment of the present invention.

Referring to FIG. 1, the motorcycle 10 is a saddle type vehicle which includes a front wheel 13, a rear wheel 16 and an engine 17. The front wheel 13 is supported at a front end portion of a vehicle body frame through a front fork 12. The rear wheel 16 is supported at a lower portion of a vehicle body frame 11 through a rear fork 14. The engine 17 is supported on the vehicle body frame 11 between the front wheel 13 and the rear wheel 16.

The vehicle body frame 11 includes a head pipe 21, a pair of left and right main frames 22, a pair of left and right pivot frames 23, and a pair of left and right seat rails 24.

The head pipe 21 configures a front end portion of the vehicle body frame 11 and supports the front fork for steering operation thereon. The left and right main frames 22 linearly extend obliquely rearwardly downwards from the head pipe 21 and support a fuel tank 26 at an upper portion thereof. The left and right pivot frames 23 extend downwardly and forwardly from a lower end portion of the main frames 22. The left and right seat rails 24 extend obliquely rearwardly upwards from a rear portion of the main frames 22 and supports thereon a seat 27 on which an occupant is to be seated.

The front fork 12 has a top bridge 28 at an upper end portion thereof, and a handlebar 31 is fixed to the top bridge 28. The front fork 12 has an axle 32 provided at a lower end portion thereof, and the front wheel 13 is supported on the axle 32. The rear fork 14 is supported at a front end portion thereof for upward and downward rocking motion on a pivot shaft 34 which is provided on the left and right pivot frames 23. The rear wheel 16 is supported at a rear end portion of the rear fork 14 through a support shaft 35. A rear cushion unit (not depicted) extends between a rear end portion of the rear fork 14 and the vehicle body frame 11.

The engine 17 in this example is of the horizontally opposed type wherein it is supported on the left and right main frames 22 and the left and right pivot frames 23 and, for example, left and right cylinder portions 17*a* project in the opposite vehicle widthwise directions. A transmission 37 is provided at a rear portion of the engine 17.

An intake system (not shown) is connected to an upper portion of the pair of left and right cylinder portions 17*a* provided on the engine 17. An exhaust pipe (not shown) is connected to a lower portion of each of the left and right cylinder portions 17*a*, and left and right silencers 41L and 41R (only the silencer 41L on this side is shown) are connected to a rear end portion of the left and right exhaust pipes. The transmission 37 has an output power shaft connected to the rear wheel 16 through a drive shaft (not shown) disposed in a hollow portion of the rear fork 14.

Part of the vehicle body is covered with a vehicle body cover 43. The vehicle body cover 43 includes a front cover 44, a pair of left and right front side covers 45, an undercover 46 and a rear cover 47. The front cover 44 covers a front portion of the vehicle body, and the front side covers 45 cover side portions of a front portion of the vehicle body. The undercover 46 covers a lower portion of a front portion of the vehicle body, and the rear cover 47 covers a rear portion of the vehicle body.

A pair of left and right saddlebacks 48 are formed integrally on the rear cover 47.

A headlamp 53 is provided on a front face of the front cover 44, and a windshield 54 is attached to an upper portion of the front cover 44. A pair of left and right mirrors 57 are provided at left and right ends of the front cover 44 and individually have a front direction indicator 56 built therein. The front side covers 45 have a pair of left and right air openings 45A provided therein for supplying eternal air from forwardly of the vehicle to the periphery of the engine 17.

The motorcycle 10 further includes a front fender 61 which covers the front wheel 13 from above, an engine guard 62 which covers the cylinder portions 17*a* of the engine 17 from the front, a fog lamp 63 attached to the engine guard 62, and a pair of left and right rider's steps 64. The motorcycle 10 further includes a pair of left and right passenger's steps 66, a grab rail 67 for being grasped by a passenger, a main stand 68, a side stand 71, a trunk box 72 attached to a rear portion of the left and right seat rails 24, and a rear fender 73 which covers the rear wheel 16 from above.

Figure 2:
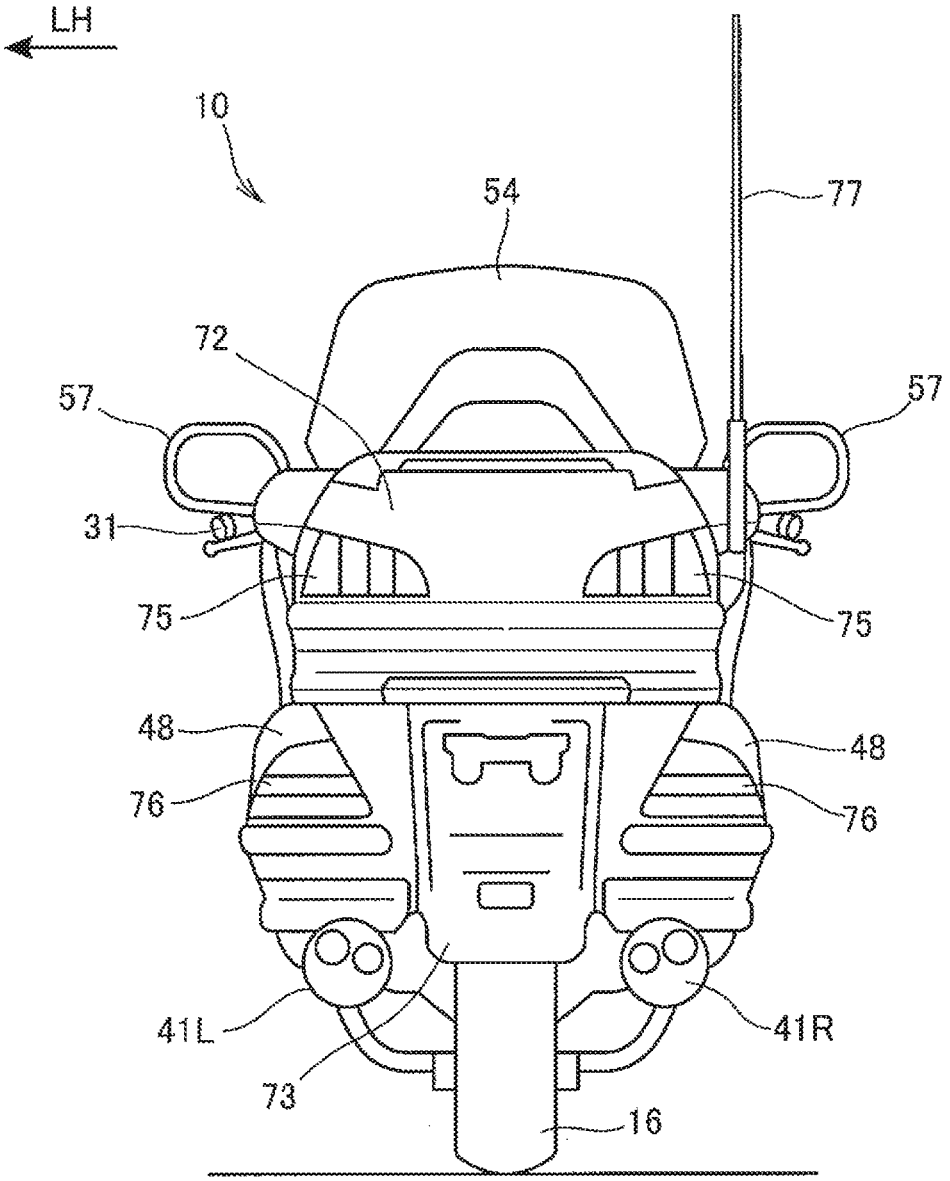
FIG. 2 is a rear elevational view illustrating the motorcycle.

FIG. 2 is a rear elevational view illustrating the motorcycle 10.

A pair of left and right tail lamp units 75 are provided on a rear face of the trunk box 72, and a direction indicator unit 76 is provided on the rear face of each of the left and right saddlebacks 48. Each of the tail lamp units 75 has built therein a tail lamp which is turned in an interlocking relationship with turning on of the headlamp 53 (refer to FIG. 1) and a stop lamp which is turned on when a rider operates the brake. Each of the direction indicator units 76 has a direction indicator and a stop lamp built therein.

An audio unit, not shown, is built in the motorcycle 10, and a rod antenna 77 of the audio unit is attached to a right side portion of the trunk box 72 and is used for reception of a radio broadcast.

The pair of left and right silencers 41L and 41R are formed in leftwardly and rightwardly asymmetrical shapes with each other from such reasons that the drive shaft extends along a right side with respect to the rear wheel 16 from a right side portion of the transmission 37 (refer to FIG. 1) and that the exhaust sounds from left and right are different from each other. The structure of the silencers 41L and 41R is described in detail below.

Figure 3:
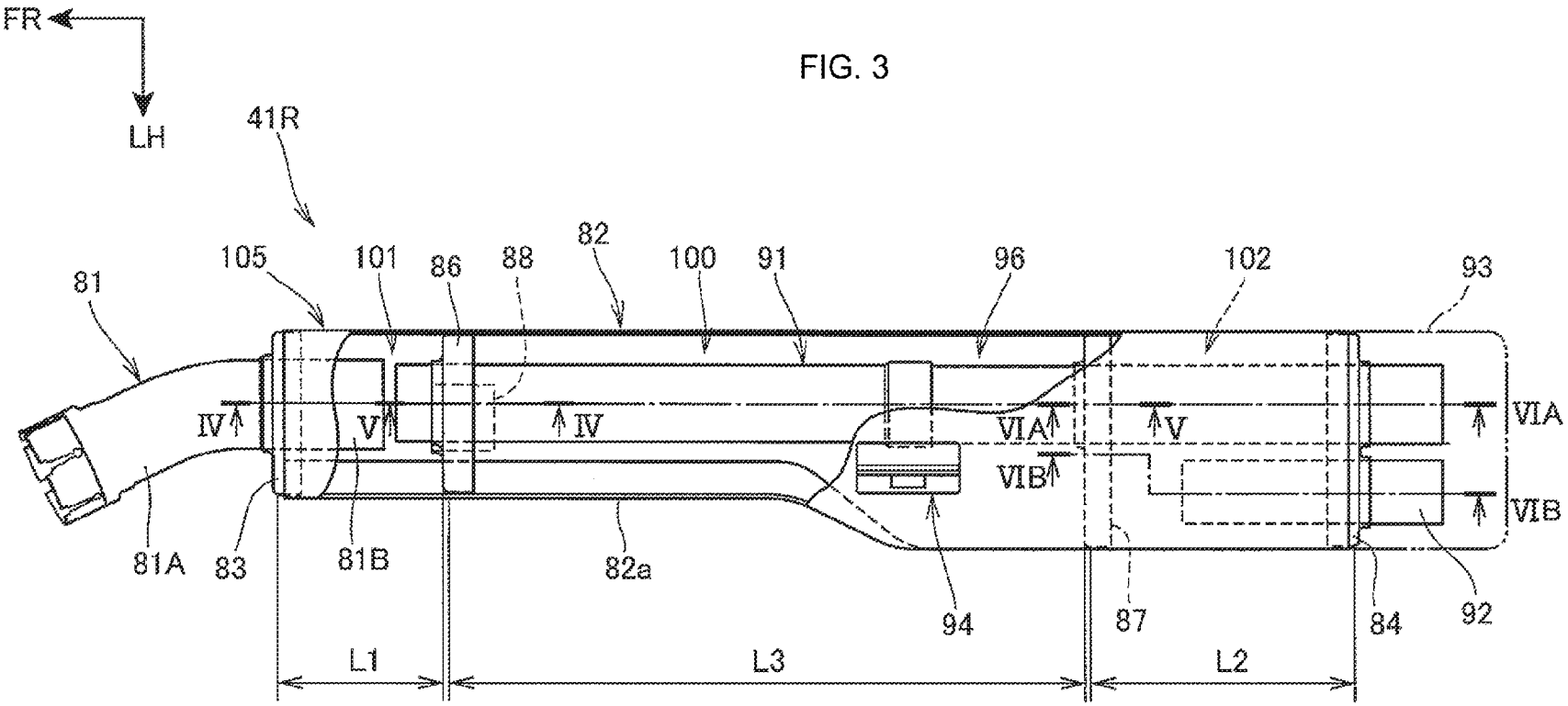
FIG. 3 is a top plan view illustrating a right side silencer.

FIG. 3 is a top plan view depicting the right side silencer 41R.

The silencer 41R includes a front connection pipe 81, an outer tube 82, a front cap member 83, a rear cap member 84, a first partition wall 86, a second partition wall 87, a resonance chamber inlet tube 88, a conduit 91, a discharge pipe 92, a rear end member 93 and a vehicle body side attachment bracket 94.

The front connection pipe 81 is a member connected to a rear end of the exhaust pipe extending from the engine 17 (refer to FIG. 1) and includes a front pipe 81A and a rear pipe 81B. The front pipe 81A extends obliquely rearwardly rightwards from a front end thereof and is bent such that it further extends rearwardly. The rear pipe 81B is connected to a rear end of the front pipe 81A and extends in the forward and rearward direction.

The outer tube 82 extends in the forward and rearward direction and is closed up at an opening at a front end thereof with the front cap member 83 while it is closed up at an opening at a rear end thereof with the rear cap member 84. A left end portion of a front portion of the outer tube 82 is formed as a recessed face 82*a* recessed from the cylinder so as to avoid interference with the rear fork 14 (refer to FIG. 1) which is swollen to the right side in order to build the drive shaft (not shown) therein.

A space 96 defined by the outer tube 82, front cap member 83 and rear cap member 84 is partitioned by the first partition wall 86 and the second partition wall both fixed to an inner circumferential face of the outer tube 82. The space between the front cap member 83 and the first partition wall 86 is a first chamber 101; the space between the first partition wall 86 and the second partition wall 87 is a resonance chamber 100; and the space between the second partition wall 87 and the rear cap member 84 is a second chamber 102.

The rear pipe 81B is fixed to the front cap member 83, and the resonance chamber inlet tube 88 and a front end portion of the conduit 91 are fixed to the first partition wall 86. The conduit 91 is fixed at a portion displaced from the center in the forward and rearward direction thereof to the second partition wall 87, and the conduit 91 and the discharge pipe 92 are fixed to the rear cap member 84.

The resonance chamber inlet tube 88, conduit 91 and discharge pipe 92 extend in the forward and rearward direction.

The rear end member 93 attached to a rear end portion of the outer tube 82 is a member which covers rear end portions of the conduit 91 and the discharge pipe 92, which project rearwardly from the rear cap member 84, from above and from the sides. The vehicle body side attachment bracket 94, attached to an upper face of the outer tube 82, is a member which fixes the silencer 41R to the vehicle body frame 11 (refer to FIG. 1) side.

The front pipe 81A, rear pipe 81B, resonance chamber inlet tube 88, conduit 91 and discharge pipe 92 described above are formed each from a round pipe.

A portion of the silencer 41R except the front connection pipe 81 configures a silencer main body 105.

Where, in the longitudinal direction of the silencer 41R, the length of the first chamber 101 is represented by L1, the length of the second chamber 102 by L2 and the length of the resonance chamber 100 by L3, the lengths have a relationship of $L1<L2<L3$.

Figure 4:
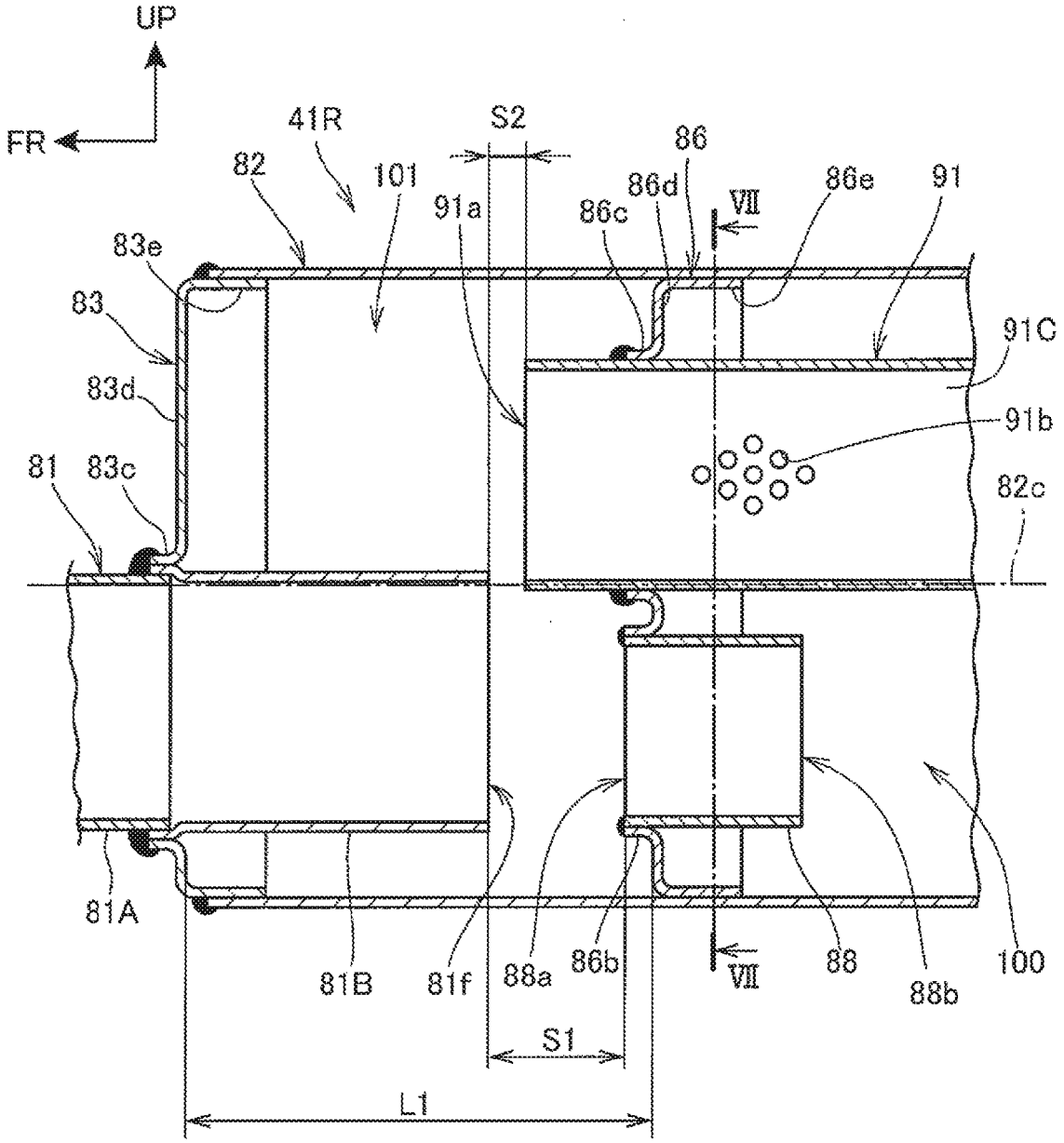
FIG. 4 is a sectional view illustrating a first chamber and associated elements of the right side silencer.

FIG. 4 is a sectional view illustrating the first chamber 101 and associated elements of the right side silencer 41R, and corresponds to a sectional view taken along line IV-IV of FIG. 3.

The front cap member 83 is molded as a unitary member including an inner side tubular portion 83*c*, a disk portion 83*d* and an outer side tubular portion 83*e*. The inner side tubular portion 83*c* is welded to an outer circumferential face of the front connection pipe 81, and the disk portion 83*d* is provided at a rear end portion of the inner side tubular portion 83*c*. The outer side tubular portion 83*e* is connected at a front end portion thereof to an outer circumferential edge of the disk portion 83*d* and is welded to an inner circumferential face of the outer tube 82.

The first partition wall 86 is molded as a unitary member including an inner side tubular portion 86*b*, another inner side tubular portion 86*c*, a disk portion 86*d* and an outer side tubular portion 86*e*. The inner side tubular portion 86*b* has the resonance chamber inlet tube 88 welded thereto such that the resonance chamber inlet tube 88 extends through the inner side tubular portion 86*b*. The inner side tubular portion 86*c* has the conduit 91 welded thereto such that the conduit extends through the inner side tubular portion 86*c*. The disk portion 86*d* is provided at rear end portions of the inner side tubular portions 86*b* and 86*c*. The outer side tubular portion 86*e* is connected at a front end portion thereof to an outer circumferential edge of the disk portion 86*d* and is welded to an inner circumferential face of the outer tube 82.

An opening 81*f* at a rear end of the rear pipe 81B, an opening 88*a* at a front end of the resonance chamber inlet tube 88 and an opening 91*a* at a front end of the conduit 91 are disposed in the first chamber 101. Meanwhile, an opening 88*b* at a rear end of the resonance chamber inlet tube 88 is disposed in the resonance chamber 100.

The rear pipe 81B and the resonance chamber inlet tube 88 are disposed such that they overlap with each other forwardly and rearwardly in the upward and downward direction and the vehicle widthwise direction (perpendicular direction to the plane of FIG. 4). Meanwhile, the rear pipe 81B and the conduit 91 are disposed such that they do not overlap in most part thereof with each other in the upward and downward direction.

Where the distance between the rear end of the rear pipe 81B and the front end of the resonance chamber inlet tube 88 along an axial line 82*c* of the outer tube 82 is represented by S1 and the distance between the rear pipe 81B and the conduit 91 along the axial line 82*c* is represented by S2, the distances have a relationship of S1>S2.

By making the length L1 of the first chamber 101 short and making a distance S1 between the rear pipe 81B and the outer tube 82 comparatively long, the overall length of the silencer 41R can be made short and adjustment of the tone of exhaust sound can be carried out by a fast flow rate of exhaust gas. Further, silencing by an expansion action in the first chamber 101 can be carried out effectively.

Further, by disposing the conduit 91 such that it only slightly overlaps with the rear pipe 81B in the forward and rearward direction, and making a distance S2 between the rear pipe 81B and the conduit 91 short, the exhaust path can be bent sharply to assure a good attenuation characteristic of the exhaust sound.

Figure 5:
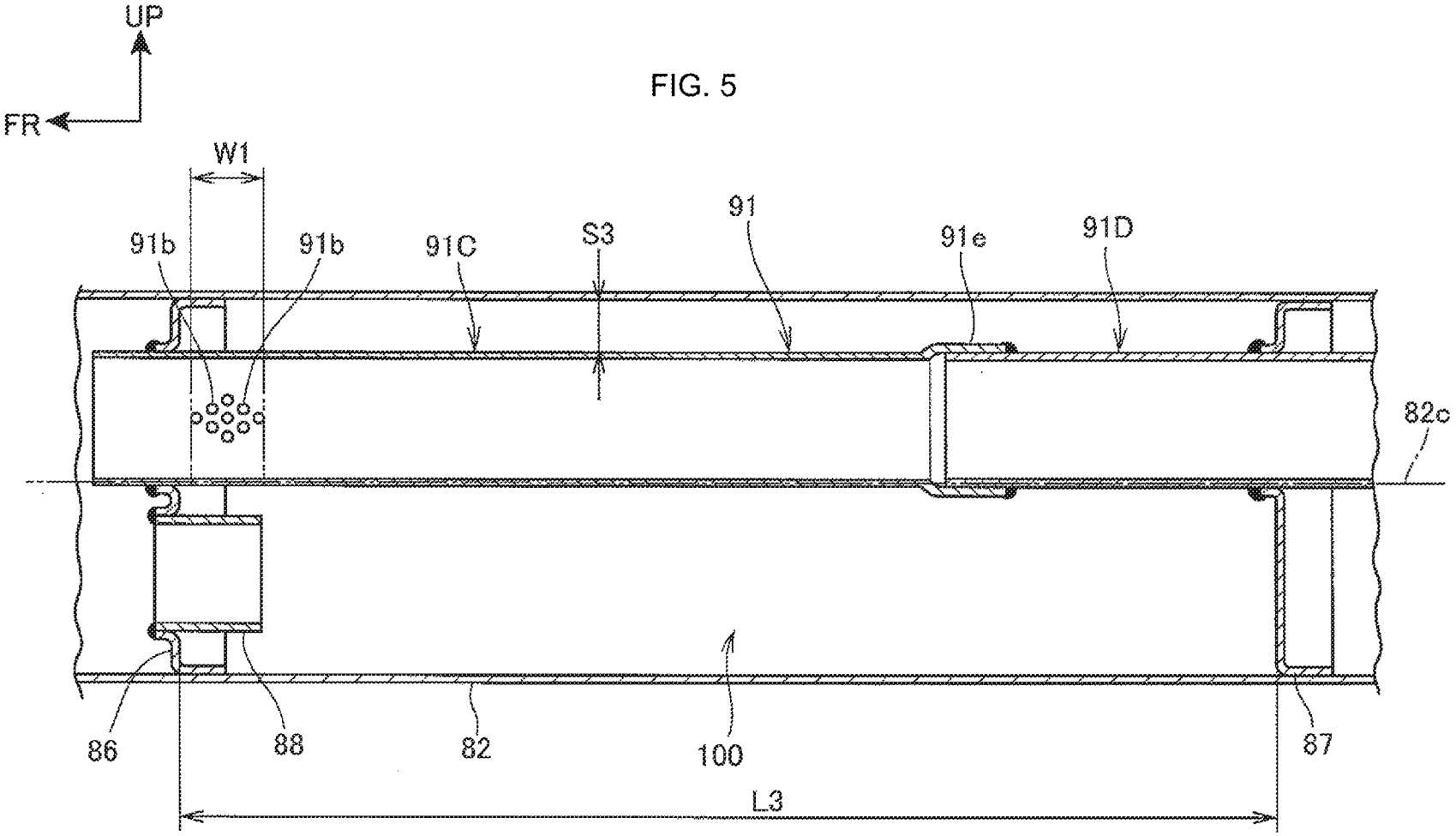
FIG. 5 is a sectional view illustrating a resonance chamber and associated elements of the right side silencer.

FIG. 5 is a sectional view illustrating the resonance chamber 100 and associated elements of the right side silencer 41R, and corresponds to a sectional view taken along line V-V of FIG. 3.

The conduit 91 is configured from a front side front conduit 91C and a rear conduit 91D connected to a rear end portion of the front conduit 91C. An increased diameter portion 91*e* having an increased diameter is formed at a rear end portion of the front conduit 91C such that a front end portion of the rear conduit 91D is inserted in the increased diameter portion 91*e*. Further, an end face of the increased diameter portion 91*e* and an outer circumferential face of the rear conduit 91D are welded to each other. The conduit 91 has an outer diameter and an inner diameter which are fixed except the increased diameter portion 81*e* thereof.

The conduit 91 has a plurality of resonance communication holes 91*b* perforated at a portion thereof behind and in the proximity of the welded position thereof to the first partition wall 86 over an overall circumference, or at part of an overall circumference within a range of a width W1 in the longitudinal direction of the conduit 91. The resonance communication holes 91*b* permits exhaust gas to flow between the inside of the resonance chamber 100 and the inside of the conduit 91. The resonance communication holes 91*b* are disposed on the upstream side of the resonance chamber 100.

Referring to FIGS. 3 and 5, an outer circumferential face of the conduit 91 and an inner circumferential face of the outer tube 82 are spaced from each other, for example, by a small distance S3 in the upward and downward direction in FIG. 5; the distance S3 is kept fixed in the longitudinal direction of the outer tube 82. In other words, the outer tube 82 has a linear shape in the longitudinal direction at least at a portion of the circumferential wall thereof which forms the resonance chamber 100, and the conduit 91 has a linear shape in the longitudinal direction at a portion thereof in the resonance chamber 100. As a result, the attenuation characteristic of the exhaust sound can be set for a predetermined restricted frequency range. Further, since the length L3 of the resonance chamber 100 is large, the attenuation effect of the exhaust sound at a low frequency can be enhanced.

Figure 6A:
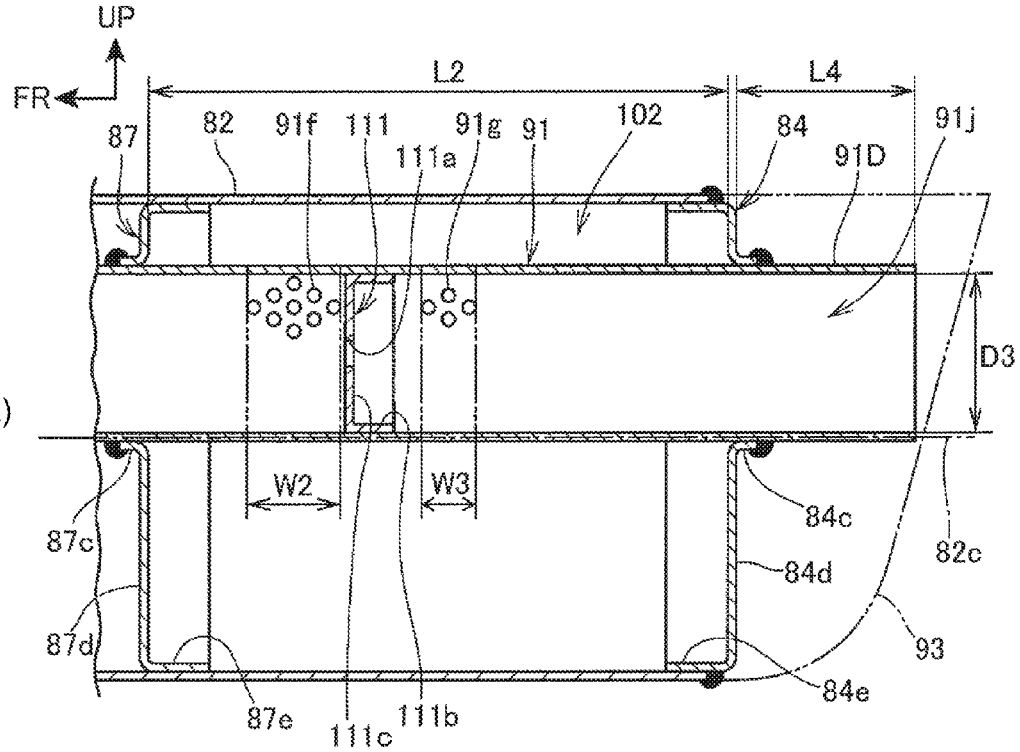
Figure 6B:
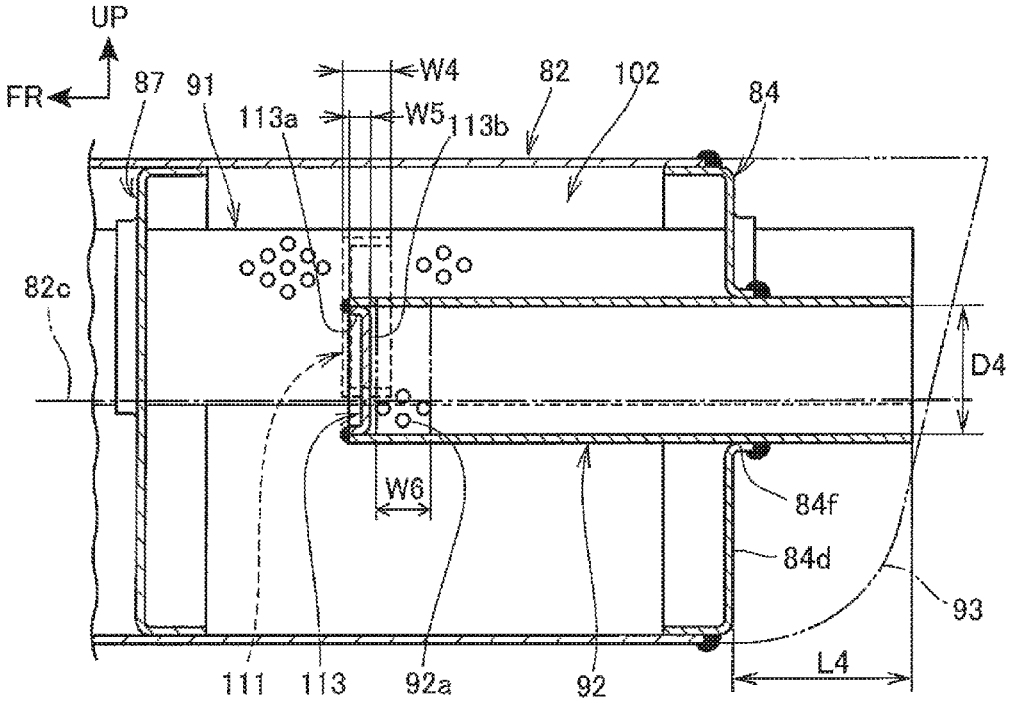

FIGS. 6A and 6B illustrate the second chamber 102 and associated elements of the right side silencer 41R. In particular, FIG. 6(A) is a sectional view taken along the conduit 91, and FIG. 6(B) is a sectional view taken along the discharge pipe 92. It is to be noted that FIG. 6(A) corresponds to a sectional view taken along line VIA-VIA of FIG. 3, and FIG. 6(B) corresponds to a sectional view taken along line VIB-VIB of FIG. 3.

As illustrated in FIG. 6(A), the second partition wall 87 is a unitary member including an inner side tubular portion 87*c*, a disk portion 87*d* and an outer side tubular portion 87*e*. The inner side tubular portion 87*c* is welded to the rear conduit 91D of the conduit 91 such that the rear conduit 91D extends through the inner side tubular portion 87*c*. The disk portion 87*d* is provided at a rear end portion of the inner side tubular portion 87*c*. The outer side tubular portion 87*e* is connected at a front end portion thereof to an outer circumferential edge of the disk portion 87*d* and welded to an inner circumferential face of the outer tube 82.

The rear cap member 84 can be a unitary member including an inner side tubular portion 84*c*, a disk portion 84*d*, and an outer side tubular portion 84*e*. The inner side tubular portion 84*c* is welded to an outer circumferential face of the rear conduit 91D of the conduit 91, and the disk portion 84*d* is provided at a front end portion of the inner side tubular portion 84*c*. The outer side tubular portion 84*e* is connected at a rear end portion thereof to an outer circumferential edge of the disk portion 84*d* and welded to an inner circumferential face of the outer tube 82. A rear end portion of the rear conduit 91D projects rearwardly by a length L4 from the rear cap member 84 (particularly, the disk portion 84*d*).

The rear conduit 91D of the conduit 91 has a barrier wall 111 fixed to an inner circumferential portion of a portion thereof, which is positioned in the second chamber 102, by spot welding or the like such that the barrier wall 111 partitions the exhaust path. The barrier wall 111 is formed as a unitary member from a tubular portion 111*b* fixed to an inner circumferential face of the rear conduit 91D and a disk portion 111*c* provided at the front end of the tubular portion 111*b*. The barrier wall 111 is disposed forwardly with respect to the center of the length L2 of the second chamber 102. The disk portion 111*c* has a plurality of small holes 111*a* for ventilation perforated therein.

In the rear conduit 91D, a plurality of upstream side communication holes 91*f* are perforated in front of and in the proximity of the barrier wall 111 over an overall circumference or at a portion of an overall circumference thereof within a range of the width W2 in the direction in which the axial line 82*c* of the outer tube 82 extends. A plurality of downstream side communication holes 91*g* are provided in the rear and in the proximity of the barrier wall 111 over an overall circumference or at part of an overall circumference within a range of the width W3 in the direction in which the axial line 82*c* extends. The upstream side communication holes 91*f* and the downstream side communication holes 91*g* allow circulation of exhaust gas between the inside of the rear conduit 91D and the inside of the second chamber 102. A portion of the rear conduit 91D in the rear of the barrier wall 111 configures a conduit discharge port 91*j* for discharging exhaust gas to the outside therethrough. The barrier wall 111 may not have the plurality of small holes 111*a* formed therein. In this case, the barrier wall 111 configures a closing portion for closing the exhaust path in the rear conduit 91D.

As shown in FIG. 6(B), the rear cap member 84 has an inner side tubular portion 84*f* provided integrally with the disk portion 84*d*, and the discharge pipe 92 extends through and is welded to the inner side tubular portion 84*f*.

The discharge pipe 92 has a front end portion disposed in the second chamber 102 and closed up with a plate-shaped discharge pipe cap member 113. The discharge pipe cap member 113 is formed as a unitary member configured from a tubular portion 113*a* fitted in and fixed to an inner circumferential face of a front end portion of the discharge pipe 92, and a disk portion 113*b* provided at one end portion of the tubular portion 113*a*.

The discharge pipe 92 is welded at a front end face thereof to a front end face of the tubular portion 113*a* of the discharge pipe cap member 113. Where, in the direction in which the axial line 82*c* of the outer tube 82 extends, the width of the barrier wall 111 of the rear conduit 91D is represented by W4 and the width of the discharge pipe cap member 113 is represented by W5, the widths have a relationship of W4>W5. Thus, the front end face of the discharge pipe 92 and the discharge pipe cap member 113 are disposed within the width W4 of the barrier wall 111 in the direction in which the axial line 82*c* of the outer tube 82 extends.

Further, a plurality of discharge pipe communication holes 92*a* are perforated in the discharge pipe 92 in the rear and in the proximity of the discharge pipe cap member 113 over an overall circumference or at part of an overall circumference within a range of the width W6 in the direction in which the axial line 82*c* extends. The discharge pipe communication holes 92*a* allow circulation of exhaust gas between the discharge pipe 92 and the second chamber 102. A rear end portion of the discharge pipe 92 projects rearwardly by a length L4 from the rear cap member 84 (particularly, from the disk portion 84*d*) similarly to the rear end portion of the rear conduit 91D.

Figure 7:
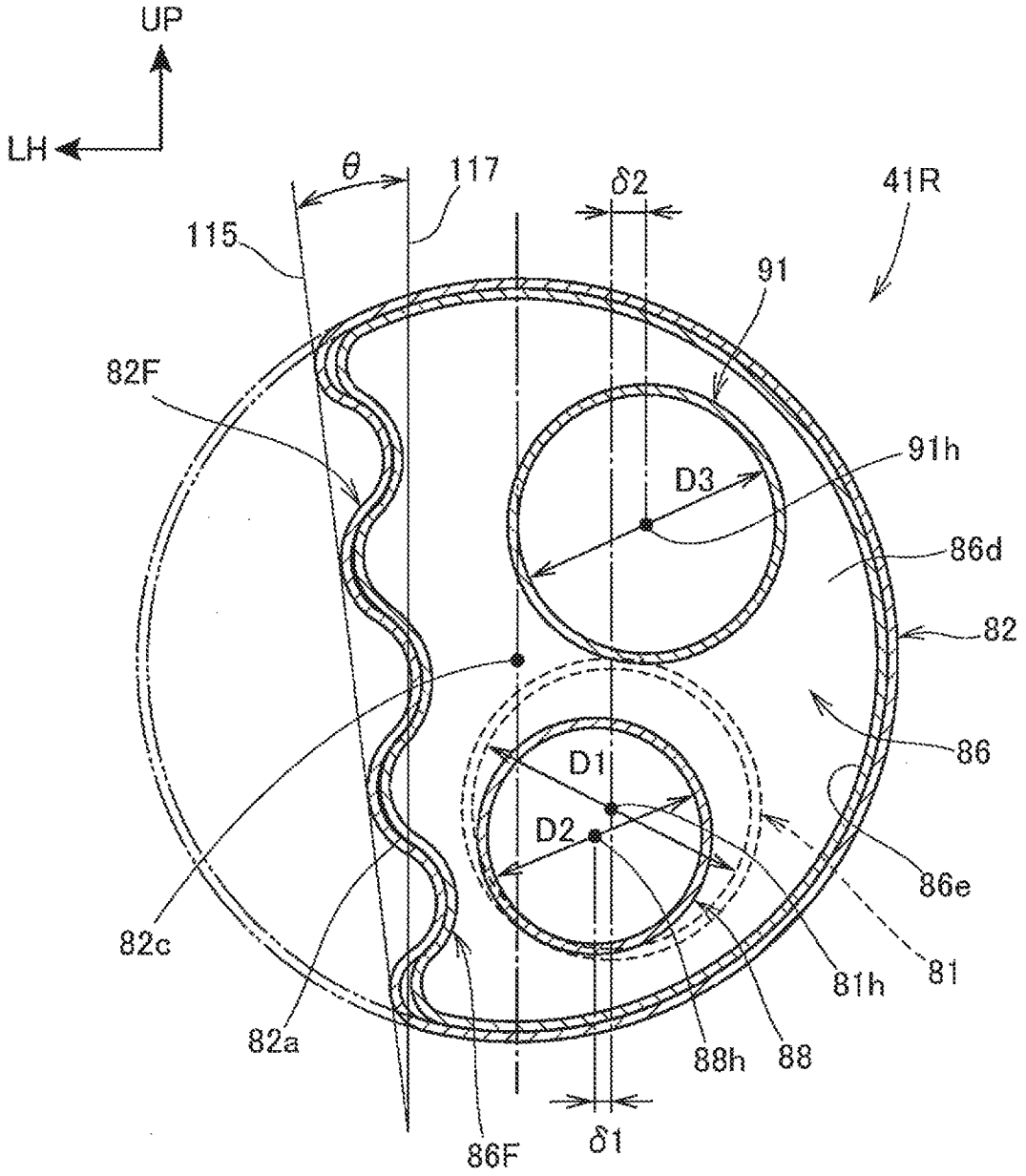
FIG. 7 is a sectional view taken along line VII-VII of FIG. 4.

FIG. 7 is a sectional view taken along line VII-VII of FIG. 4.

The outer tube 82 has a cylindrical shape at a rear half portion thereof while a front half portion thereof is formed as a corrugated wall 82F in the form of a corrugated plate by recessing a left side portion of the cylinder in FIG. 7.

The recessed face 82*a* is an outer face of the corrugated wall 82F, and at the recessed face 82*a*, a linear line 115 is inclined by an angle θ with respect to a vertical line 117 such that the upper side thereof is positioned leftwardly with respect to the lower side thereof. The first partition wall 86 has a corrugated wall 86F in the form of a corrugated plate inscribed along the corrugated wall 82F of the outer tube 82, and the corrugated wall 86F is formed as an outer side tubular portion 86*e*.

By configuring the recessed face 82*a* in a corrugated shape in this manner, the surface area of the outer tube 82 can be increased and the heat radiation property can be improved. By disposing the recessed face 82*a* in an inclined relationship by the angle θ, a lower portion of the recessed face 82*a* is less likely to be observed when the silencer 41L is viewed from above, and the appearance can be improved.

Where the inner diameter of the front connection pipe 81 (front pipe 81A and rear pipe 81B shown in FIG. 4) is represented by D1, the inner diameter of the resonance chamber inlet tube 88 by D2 and the inner diameter of the conduit 91 (front conduit 91C and rear conduit 91D shown in FIG. 5), then the inner diameters have a relationship of D1>D3>D2. Where the inner diameter of the discharge pipe 92 (refer to FIG. 6(B)) is represented by D4 (refer to FIG. 6(B)), then the diameters D3 and D4 have a relationship of D3>D4.

The resonance chamber inlet tube 88 has an axial line 88*h* offset leftwardly by an offset amount δ1 from an axial line 81*h* of the front connection pipe 81. The conduit 91 has an axial line 91*h* offset rightwardly by another offset amount δ2 from the axial line 81*h* of the front connection pipe 81.

Since the resonance chamber inlet tube 88 overlaps over an overall area thereof with the front connection pipe 81 in the direction in which the axial line 81*h* extends, exhaust gas passing through the front connection pipe 81 is liable to flow into the resonance chamber inlet tube 88. Since the conduit 91 does not overlap with the front connection pipe 81 in the direction in which the axial line 81*h* extends, exhaust gas flowing out from the front connection pipe 81 flows along a curved path into the conduit 91.

Figure 8:
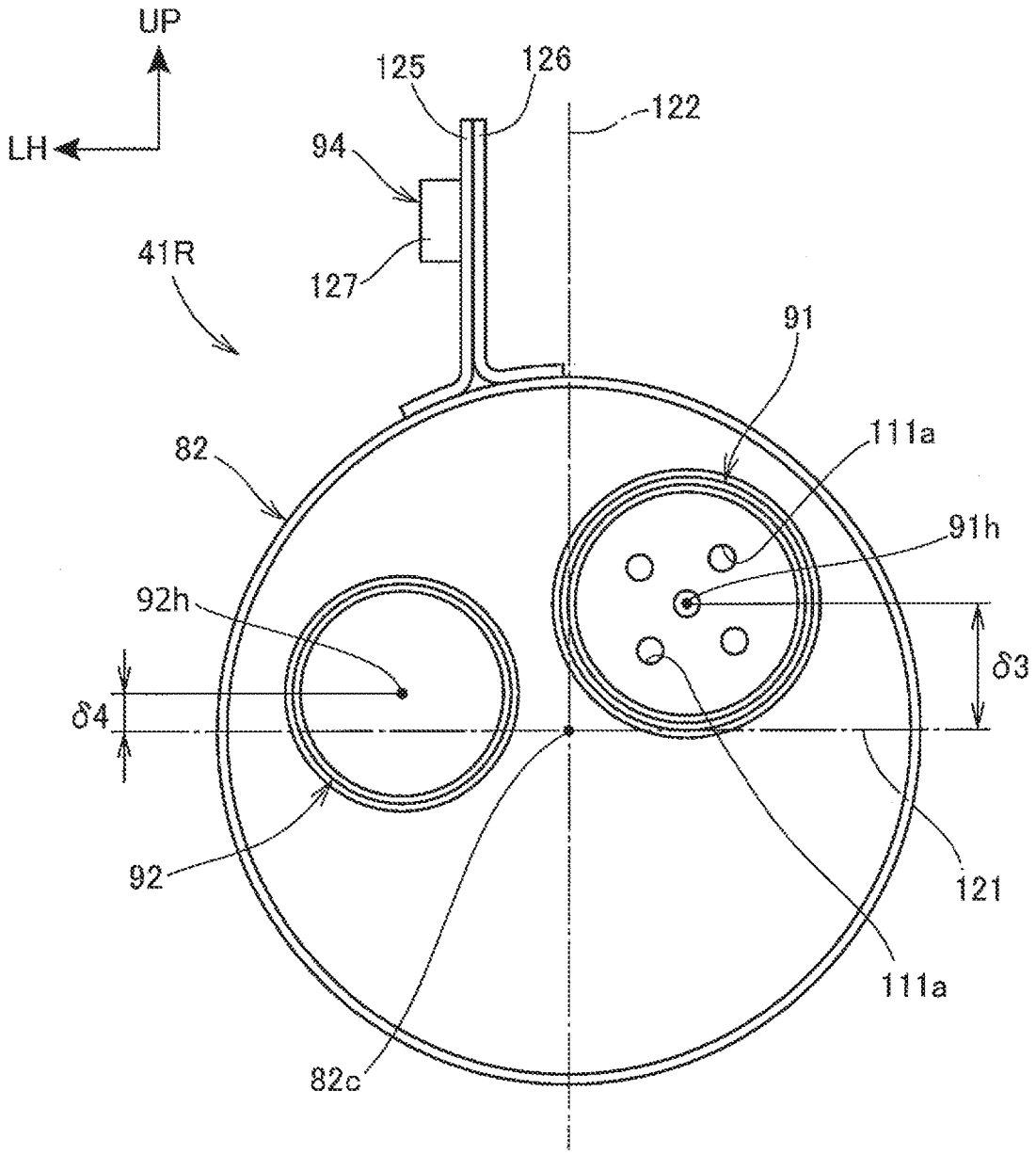
FIG. 8 is a rear elevational view illustrating the right side silencer.

FIG. 8 is a rear elevational view illustrating the right side silencer 41R.

The axial line 91*h* of the conduit 91 is positioned upwardly by an offset amount δ3 from the axial line 82*c* of the outer tube 82, and an axial line 92*h* of the discharge pipe 92 is positioned upwardly by another offset amount δ4. The offset amounts δ3 and δ4 have a relationship of δ3>δ4. Meanwhile, the conduit 91 is positioned upwardly over an overall area thereof from a horizontal line 121 which passes the axial line 82*c* of the outer tube 82, and the discharge pipe 92 is positioned upwardly at a portion more than half thereof with respect to the horizontal line 121. By providing the rear end portions of the conduit 91 and the discharge pipe 92 rather near to an upper half of the silencer 41R in this manner, the appearance provides lightness to the user.

Furthermore, the conduit 91 is positioned at most part thereof on the right side with respect to a vertical line 122 which passes the axial line 82*c*, and the discharge pipe 92 is positioned at most part thereof on the left side with respect to the vertical line 122.

The vehicle body side attachment bracket 94 is configured from a pair of left and right plate members 125 and 126 of a substantially L shape as viewed in the rear elevational view. The bracket is welded to an outer circumferential face of the outer tube 82, and a nut member 127 is attached to a side face of the plate member 125. The vehicle body side attachment bracket 94 is disposed at an overall portion thereof leftwardly with respect to the vertical line 122.

Figure 9:
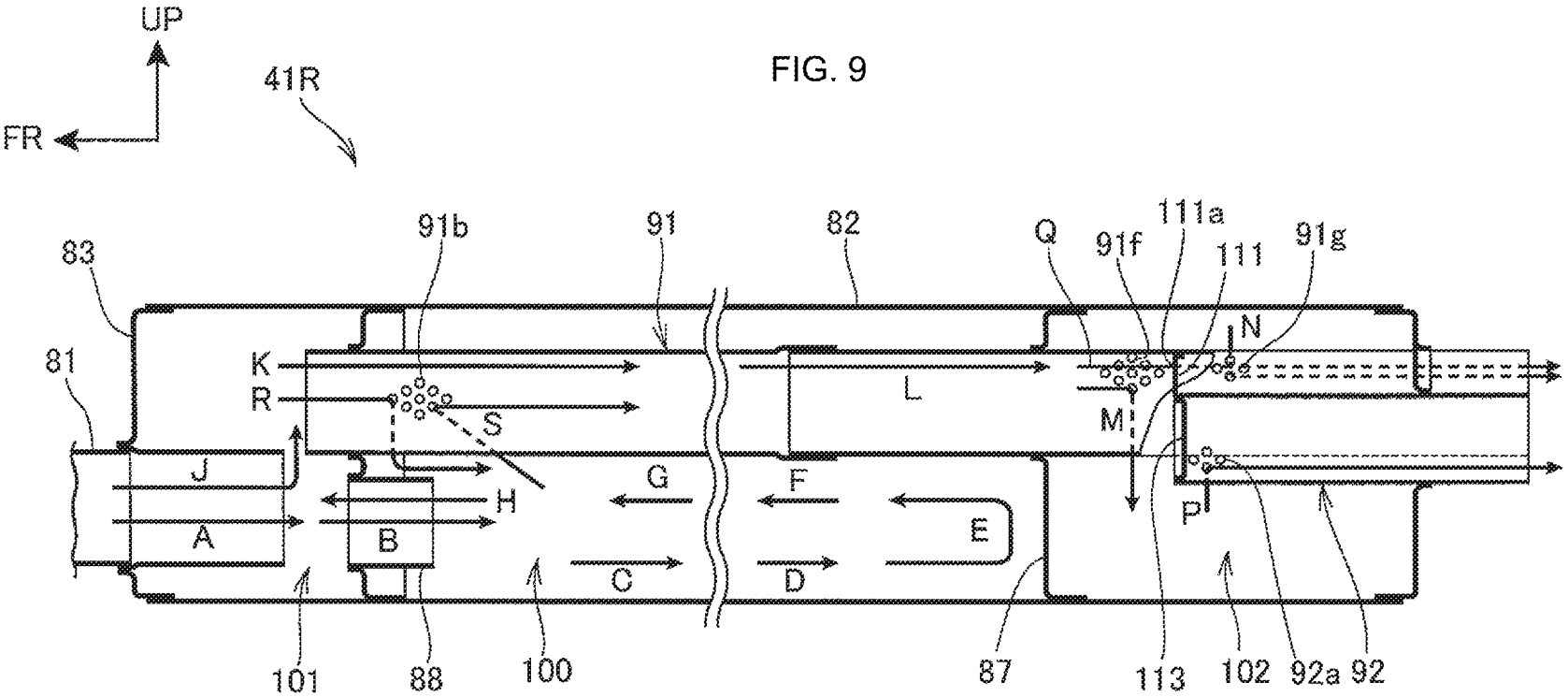
FIG. 9 is an operational view illustrating a flow of exhaust gas in the right side silencer.

FIG. 9 is an operational view illustrating a flow of exhaust gas in the right side silencer 41R.

Exhaust gas coming to the front connection pipe from the engine 17 (refer to FIG. 1) through the exhaust pipe flows from the front connection pipe 81 into and is expanded in the first chamber 101, as indicated by an arrow mark A. As a result, energy of the exhaust sound decreases. In other words, the exhaust sound is attenuated. The exhaust gas flows linearly into the resonance chamber inlet tube 88 from the first chamber 101 and further flows into the resonance chamber 100 as indicated by an arrow mark B. In the resonance chamber 100, the exhaust gas advances in the inside of the resonance chamber 100 as indicated by arrow marks C and D and bounces off the second partition wall 87 as indicated by an arrow mark E. However, since the resonance chamber 100 has a relatively large length, the exhaust sound is attenuated significantly. Further, the exhaust gas advances in a reverse direction in the resonance chamber 100 as indicated by arrow marks F and G, and sometimes flows out from the resonance chamber 100 through the resonance chamber inlet tube 88 as indicated by an arrow mark H.

The exhaust gas in the front connection pipe 81 flows into and expands in the first chamber 101 and turns at an acute angle as indicated by an arrow mark J and then flows from the first chamber 101 into the conduit 91 as indicated by an arrow mark K. The exhaust gas advances in the conduit 91 as indicated by an arrow mark L and then flows into and expands in the second chamber 102 past the upstream side communication holes 91*f* provided in front of the barrier wall 111 as indicated by an arrow mark M. The exhaust gas in the second chamber 102 flows into the conduit 91 behind the barrier wall 111 past the downstream side communication holes 91*g* of the conduit 91 from within the second chamber 102 as indicated by an arrow mark N, and then advances in the conduit 91 and is discharged to the outside from the conduit 91. Similarly, the exhaust gas in the second chamber 102 flows into the discharge pipe 92 past the discharge pipe communication holes 92*a* of the discharge pipe 92 from within the second chamber 102 as indicated by an arrow mark P, and is discharged to the outside from the discharge pipe 92.

The exhaust gas in the conduit 91 on the upstream of the barrier wall 111 flows into the conduit 91 behind the barrier wall 111 past the small holes 111*a* of the barrier wall 111 as indicated by an arrow mark Q and is discharged to the outside from the conduit 91.

The exhaust gas in the first chamber 101 flows into the resonance chamber 100 past the resonance communication holes 91*b* from within the conduit 91 as indicated by an arrow mark R. Reversely, the exhaust gas in the resonance chamber 100 sometimes flows into the conduit 91 past the resonance communication holes 91*b* as indicated by an arrow mark S.

As principal features which result in the exhaust sound attenuation effect of the silencer 41R, (1) the resonance chamber inlet tube 88 is provided in an overlapping relationship behind the front connection pipe 81 and the length L3 (refer to FIG. 3) of the resonance chamber 100 is made large, (2) the conduit 91 is provided not in an overlapping relationship behind the front connection pipe 81 thereby to bend the flow of exhaust gas at an acute angle, (3) the conduit 91 is formed long and the resonance communication holes 91*b* are provided on the upstream side of the conduit 91 while the upstream side communication holes 91*f*, downstream side communication holes 91*g* and barrier wall 111 are provided on the downstream side of the conduit 91, and (4) the discharge pipe cap member 113 and the discharge pipe communication holes 92*a* are provided on the discharge pipe 92, can be listed.

By increasing the length L3 of the resonance chamber 100, the silencing performance is assured and the outer diameter (namely, the sectional area) of the outer tube 82 can be reduced. Further, since the silencing performance is improved significantly due to the features (1) to (4) described above, the outer tube 82, specifically the lengths L1 and L2 (refer to FIG. 3) of the first chamber 101 and the second chamber 102, can be reduced. From this, downsizing of the silencer 41R can be anticipated.

Further, as a feature for making the attenuation characteristic in a predetermined frequency region of the exhaust sound fixed, (5) the distance S3 (refer to FIG. 5) between the outer circumferential face of the conduit 91 and the inner circumferential face of the outer tube 82 is made fixed can be listed.

Further, as additional features which improve the output power of the engine 17 (refer to FIG. 1), (6) the resonance chamber inlet tube 88 is provided in an overlapping relationship behind the front connection pipe and (7) exhaust gas is discharged to the outside by both of the conduit discharge port 91*j* (refer to FIG. 6(A)) of the conduit 91 and the discharge pipe 92 can be listed.

As described above, in the silencer 41L, while increase of the ventilation resistance which has an influence on the output power of the engine 17 is prevented, a required attenuation characteristic of exhaust sound is obtained within a restricted volume.

Figure 10:
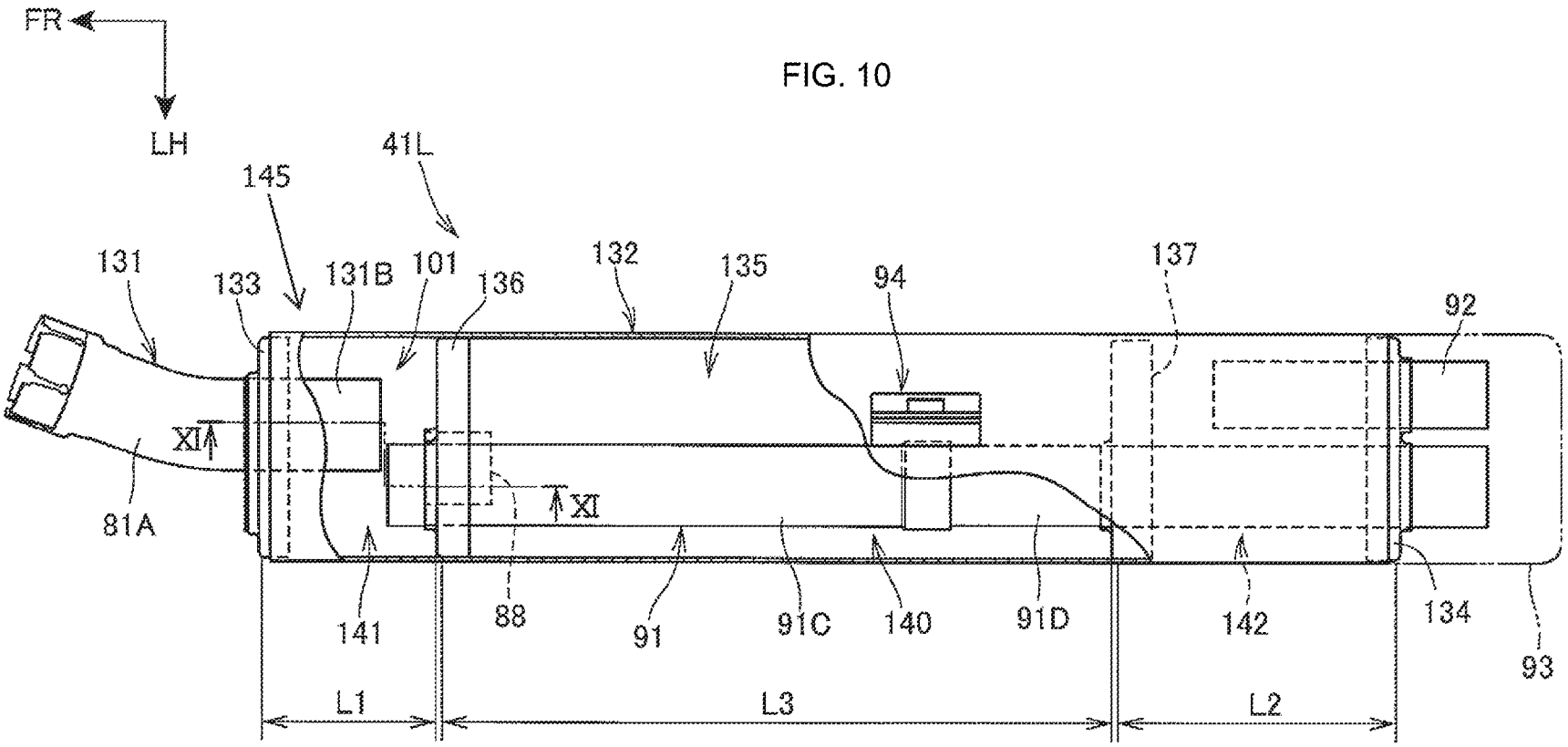
FIG. 10 is a top plan view illustrating a left side silencer.
Figure 11:
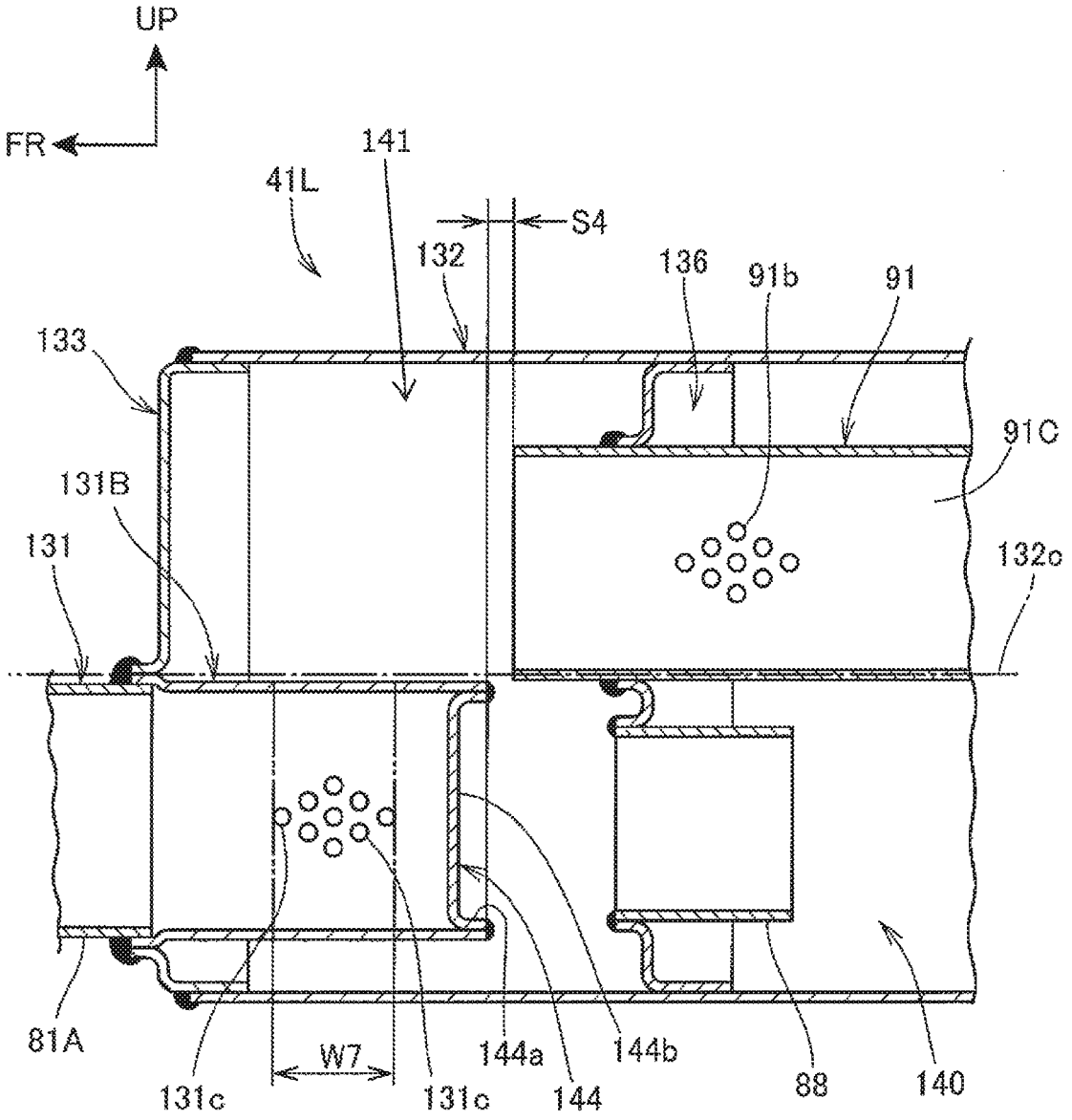
FIG. 11 is a sectional view illustrating a first chamber and associated elements of the left side silencer.

FIG. 10 is a top plan view illustrating the left side silencer 41L. FIG. 11 is a sectional view illustrating a first chamber 141 and associated elements of the left side silencer 41L and corresponds to a sectional view taken along line XI-XI of FIG. 10. Like elements to those of the right side silencer 41R are denoted by like reference characters and overlapping detailed description of them is omitted herein to avoid redundancy.

As shown in FIG. 10, the silencer 41L is different from the silencer 41R illustrated in FIG. 3 in a front connection pipe 131, an outer tube 132, a front cap member 133, a rear cap member 134, a space 135, a first partition wall 136, a second partition wall 137, a first chamber 141, a second chamber 142, a resonance chamber 140 and a silencer main body 145.

The front connection pipe 131 is configured from a front pipe 81A and a rear pipe 131B connected to a rear end portion of the front pipe 81A. The outer tube 132 has a generally cylindrical shape and has a front end portion to which the front cap member 133 is welded and a rear end portion to which the rear cap member 134 is connected. The space 135 in the outer tube 132 is partitioned by the first partition wall 136 and the second partition wall 137. In the space 135 in the outer tube 132, the first chamber 141 is formed between the front cap member 133 and the first partition wall 136, and the second chamber 142 is formed between the second partition wall 137 and the rear cap member 134. Further, the resonance chamber 140 is formed between the first partition wall 136 and the second partition wall 137. In the longitudinal direction of the outer tube 132, the first chamber 141, second chamber 142 and resonance chamber 140 have lengths L1, L2 and L3, respectively.

The front connection pipe 131 extends through and is welded to the front cap member 133. Front end portions of the resonance chamber inlet tube 88 and the conduit 91 extend through and are welded to the first partition wall 136. A rear portion of the conduit 91 extends through and is welded to the second partition wall 137. Rear end portions of the conduit 91 and the discharge pipe 92 extend through and are welded to the rear cap member 134.

A portion of the silencer 41L except the front connection pipe 131 configures the silencer main body 145.

In the examples shown in FIGS. 3 and 10, the rear cap member 84 and the rear cap member 134, and the second partition wall 87 and the second partition wall 137, have leftwardly and rightwardly symmetrical shapes with each other.

As shown in FIG. 11, the rear pipe 131B has a rear pipe cap member 144 fixed to an inner circumferential face of a rear end portion thereof by welding and is closed at the rear end thereof with the rear pipe cap member 144. A plurality of rear pipe communication holes 131*c* are perforated at an intermediate portion of the rear pipe 131B in the longitudinal direction over an overall circumference or at part of an overall circumference. The rear pipe cap member 144 is formed as a unitary member from a tubular portion 144*a* fitted in and fixed to an inner circumferential face of the rear pipe 131B, and a disk portion 144*b* provided at a front end of the tubular portion 144*a*.

In the direction in which an axial line 132*c* of the outer tube 132 extends, a distance S4 between a rear end face of the rear pipe 131B and a front end face of the conduit 91 is smaller than the distance S2 (refer to FIG. 4) between a rear end face of the rear pipe 81B (refer to FIG. 4) and a front end face of the conduit 91 (S4<S2). By making the distance S4 smaller than the distance S2, the volume in the rear pipe 131B can be increased. Further, by providing the rear pipe cap member 144 and the rear pipe communication holes 131*c*, if exhaust gas is introduced from within the rear pipe 131B into the first chamber 141 past the rear pipe communication holes 131*c*, then the exhaust gas can be expanded and the attenuation characteristic of exhaust sound can be improved.

In this manner, since the rear pipe 131B of the left side silencer 41L is closed with the rear pipe cap member 144 and the rear pipe communication holes 131*c* are provided in the rear pipe 131B while the structure of the rear pipe 131B is made different from that of the right side silencer 41R (refer to FIG. 4), exhaust sounds of the left and right silencers 41L and 41R can be made different from each other. Consequently, novel merchantability can be provided to the motorcycle 10.

As shown in FIGS. 3 and 4 and FIG. 6(A), a silencer 41R includes a silencer main body 105 as a main body, including an outer tube 82 closed at front and rear ends thereof. A front connection pipe 81 as an exhaust connection pipe is provided to which an exhaust pipe extending from an engine 17 (refer to FIG. 1) side is connected and a discharge pipe 92 for discharging exhaust gas to the outside therethrough are connected, respectively. A first partition wall 86 and a second partition wall 87 are provided in order from the upstream side in the main body 105 such that the inside of the main body 105 is partitioned into a first chamber 101 and a resonance chamber 100 by the first partition wall 86 and is partitioned into the resonance chamber 100 and a second chamber 102 by the second partition wall 87. A conduit 91 is supported on the first partition wall 86 and the second partition wall 87. The conduit 91 has a downstream end portion configured from a tubular member including a conduit discharge port 91*j* which extends through the main body 105 and which discharges exhaust gas to the outside. The tubular member includes a resonance communication hole 91*b* which communicates with the resonance chamber 100 and an upstream side communication hole 91*f* and a downstream side communication hole 91*g* which communicate with the second chamber 102. A closing portion which closes an exhaust path at an intermediate location of the tubular member, or a barrier wall 111 as a throttle portion which throttles the exhaust path, is provided between the upstream side communication hole 91*f* and the downstream side communication hole 91*g* in the inside of the tubular member.

With the configuration described above, by disposing the conduit 91 so as to extend from the resonance chamber 100 on the upstream side to the second chamber 102, the conduit 91 can be formed long and the attenuation characteristic of exhaust sound can be improved. By providing the closing portion or the barrier wall 111 in the second chamber 102, the pressure in the conduit 91 can be raised thereby to allow exhaust gas to flow with certainty into the resonance chamber 100 and the second chamber 102 through the resonance communication holes 91*b* and the upstream side communication holes 91*f*. Consequently, the attenuation characteristic of exhaust sound is improved.

Furthermore, since the conduit 91 is supported on the first partition wall 86 and the second partition wall 87 and disposed so as to extend from the first chamber 101 to the second chamber 102, even with a structure with which the temperature of the second chamber 102 is liable to become high, the heat of the first chamber 101 heated by a high exhaust gas temperature is less likely to reach the second chamber 102. Consequently, the temperature in the second chamber 102 is maintained to be relatively low, and the heat energy the exhaust gas has is radiated and the silencing performance can be improved. Further, by providing the conduit discharge port 91*j* in addition to the discharge pipe 92 in order to discharge exhaust gas to the outside, the exhaust resistance can be made low and the output power of the engine can be improved. Further, by reducing the length or the sectional area of the silencer 41R, downsizing of the silencer 41R can be anticipated.

Since the resonance communication holes 91*b* are disposed on the upstream side of the resonance chamber 100 as shown in FIG. 5, it is possible to increase the distance between the resonance communication holes 91*b* and the closing portion or the barrier wall 111 thereby to increase the distance by which the exhaust sound bouncing off the closing portion or the barrier wall 111 reaches the resonance chamber 100 to fold back the elongated pipe. This can achieve a good attenuation characteristic of the exhaust sound.

Further, as shown in FIG. 3, the outer tube 82 is formed, at least at part of a circumferential wall (outer tube 82) thereof which forms the resonance chamber 100, in a linear shape in the longitudinal direction. Further, the conduit 91 is formed, at a portion thereof in the resonance chamber 100, in a linear shape in the longitudinal direction. Therefore, the distance between the conduit 91 in the resonance chamber 100 and the circumferential wall of the resonance chamber 100 can be made fixed thereby to suppress dispersion in frequency of the exhaust sound to be attenuated.

Further, as shown in FIG. 6(A), the barrier wall 111 is a vertical wall welded in the conduit 91 and has small holes 111*a* as openings of a small diameter. Therefore, by forming the barrier wall 111 and the conduit 91 as separate members, it is possible to adjust, by preparing a plurality of barrier walls 111 having small holes 111*a* of different areas (sectional areas) from each other, the sound characteristics (magnitude, pitch and tone) of the exhaust sound.

As shown in FIGS. 4 and 7, the resonance chamber inlet tube 88 attached to the first partition wall 86 in order to introduce exhaust gas from the first chamber 101 into the resonance chamber 100 is disposed on the downstream of the front connection pipe 81. Thus, when viewed from an axial line direction of the front connection pipe 81, the resonance chamber inlet tube 88 overlaps with the front connection pipe 81. Therefore, the exhaust gas can flow into the resonance chamber 100 from the front connection pipe 81 through the first chamber 101 and the resonance chamber inlet tube 88. Consequently, the resonance effect can be enhanced and the attenuation characteristic of exhaust sound can be improved.

Further, as shown in FIG. 6(B), the discharge pipe 92 includes the discharge pipe cap member 113 as a closing member which closes a front end portion thereof disposed in the second chamber 102. Further, the discharge pipe 92 has the discharge pipe communication holes 92*a* perforated therein which communicate the second chamber 102 and the inside of the discharge pipe 92 with each other. Therefore, since the exhaust gas can flow from the second chamber 102 into the discharge pipe 92 past the discharge pipe communication holes 92*a*, the attenuation characteristic of exhaust sound can be improved.

Figure 12:
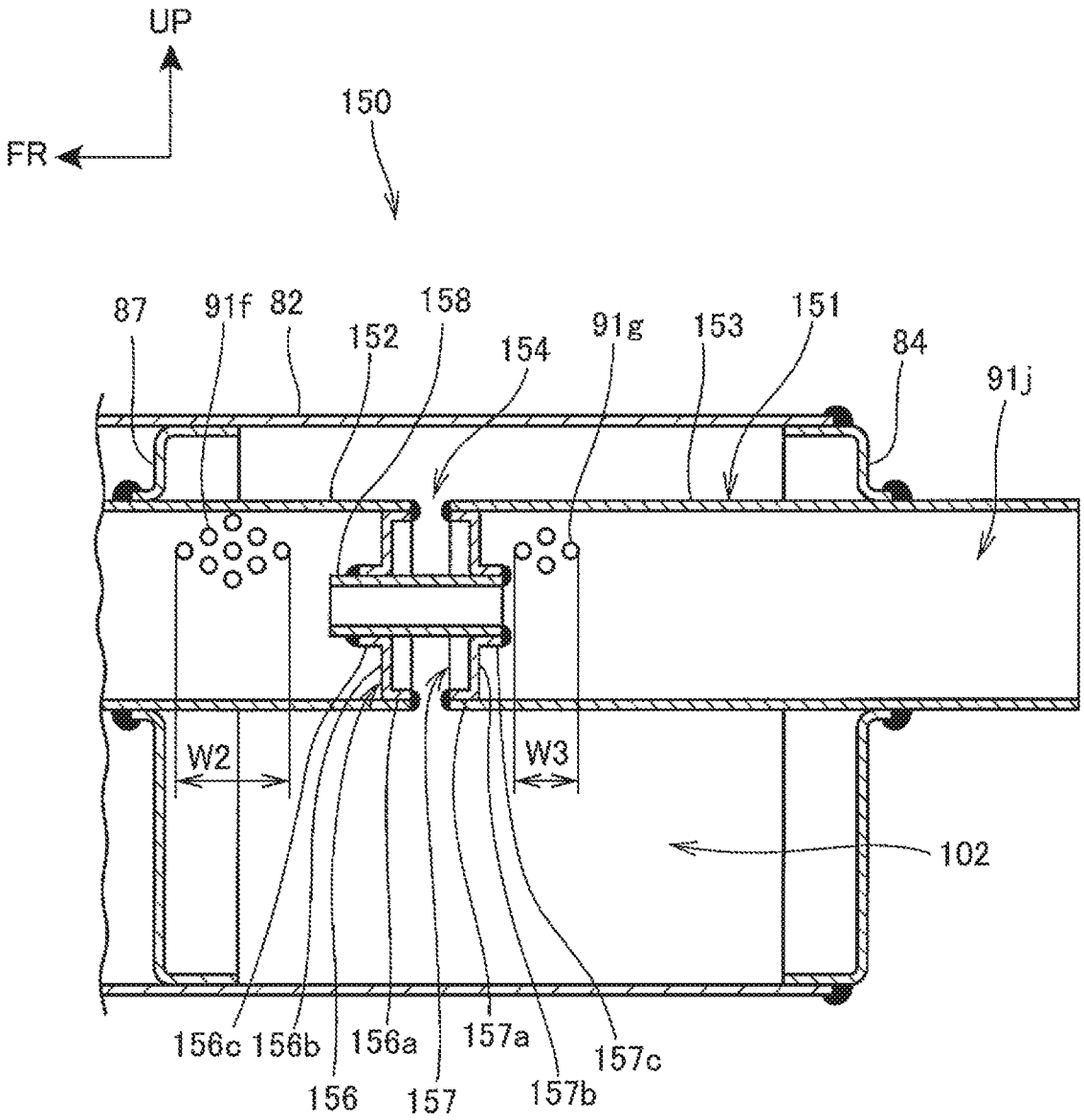
FIG. 12 is a sectional view taken along a conduit illustrating a second chamber and associated elements of a silencer according to a second embodiment of the present invention.

FIG. 12 is a sectional view taken along a conduit 151, depicting a second chamber 102 and associated elements of a silencer 150 of a second embodiment. Like elements to those of the first embodiment shown in FIGS. 6A and 6B are denoted by like reference symbols, and overlapping detailed description of them is omitted herein to avoid redundancy.

The silencer 10 includes the conduit 151 in place of the conduit 91 in the silencer 41R (see FIG. 3).

The conduit 151 is configured from an upstream conduit 152 and a downstream conduit 153 disposed in a forward and rearwardly spaced relationship from each other in a second chamber 102 and a connection portion 154 which connects and communicates the upstream conduit 152 and the downstream conduit 153 to and with each other.

The upstream conduit 152 is formed from a round pipe and is fixed to the first partition wall 86 (FIG. 4) and the second partition wall 87 similarly to the conduit 91. A plurality of resonance communication holes 91*b* (FIG. 4) are perforated at a front end portion of the upstream conduit 152 while a plurality of upstream side communication holes 91*f* are perforated at a rear portion of the upstream conduit 152.

The downstream conduit 153 is formed from a round pipe and is fixed to the rear cap member 84 similarly to the conduit 91. A plurality of downstream side communication holes 91*g* are perforated at a front portion of the downstream conduit 153.

The connection portion 154 is configured from a rear end cap member 156, a front end cap member 157 and a conduit connection pipe 158. The rear end cap member 156 is fixed to an inner circumferential face of a rear end portion of the upstream conduit 152 in such a manner as to close a rear end opening of the upstream conduit 152. The front end cap member 157 is fixed to an inner circumferential face of a front end portion of the downstream conduit 153 in such a manner as to close a front end opening of the downstream conduit 153. The conduit connection pipe 158 is fixed to inner faces of the rear end cap member 156 and the front end cap member 157 and communicates the upstream conduit 152 and the downstream conduit 153 with each other.

The rear end cap member 156 can be a unitary member including an outer side tubular portion 156*a*, a disk portion 156*b* and an inner side tubular portion 156*c*. The outer side tubular portion 156*a* is fixed to an inner circumferential face of the upstream conduit 152 by welding. Disk portion 156*b* extends inwardly in a radial direction from a front end portion of the outer side tubular portion 156*a*. The inner side tubular portion 156*c* extends forwardly from an inner circumferential edge of the disk portion 156*b* and is fixed to an outer circumferential face of the conduit connection pipe 158 by welding.

The front end cap member 157 is a unitary member including an outer side tubular portion 157*a*, a disk portion 157*b* and an inner side tubular portion 157*c*. The outer side tubular portion 157*a* is fixed to an inner circumferential face of the downstream conduit 153 by welding, and the disk portion 157*b* extends inwardly in a radial direction from a rear end portion of the outer side tubular portion 157*a*. The inner side tubular portion 157*c* extends rearwardly from an inner circumferential edge of the disk portion 157*b* and is fixed to an outer circumferential face of the conduit connection pipe 158 by welding.

The conduit connection pipe 158 is formed from a thin round pipe and is formed with an inner diameter smaller than that of the upstream conduit 152 and the downstream conduit 153 and acts similarly to the small holes 111*a* of the barrier wall 111 shown in FIG. 6(A).

As shown in FIG. 12, the conduit connection pipe 158 as a throttle portion is a pipe member which communicates and connects the upstream conduit 152 including the upstream side communication holes 91*f* and the downstream conduit 153 including the downstream side communication holes 91*g* with and to each other. Therefore, by connecting the upstream conduit 152 and the downstream conduit 153 to each other by the conduit connection pipe 158, exhaust gas to flow to the downstream side is rectified by the conduit connection pipe 158 having a small diameter and the exhaust gas flowing out from the downstream side communication holes 91*g* is not disturbed.

The embodiments described above essentially indicate modes of the present invention and can be modified and applied arbitrarily without departing from the subject matter of the present invention.

The present invention can be applied not only to the motorcycle 10 but also to saddle type vehicles other than the motorcycle 10. It is to be noted that the saddle type vehicles include general vehicles on which a rider rides astride a vehicle body and include not only motorcycles (including bicycles with a prime mover) but also three-wheeled vehicles and four-wheeled vehicles classified to ATVs (all-terrain vehicles).

DESCRIPTION OF REFERENCE SYMBOLS

10: Motorcycle (saddle type vehicle)
17: Engine
41L, 41R, 150: Silencer
81, 131: Front connection pipe (exhaust connection pipe)
82, 132: Outer tube
86, 136: First partition wall
87, 137: Second partition wall
88: Resonance chamber inlet tube
91, 151: Conduit
91*b*: Resonance communication hole
91*f*: Upstream side communication hole
91*g*: Downstream side communication hole
91*j*: Conduit discharge port

92: Discharge pipe
92*a*: Discharge pipe communication hole
100, 140: Resonance chamber
101, 141: First chamber
102, 142: Second chamber
105, 145: Silencer main body (main body)
111: Barrier wall (throttle portion)
111*a*: Small hole (opening)
113: Discharge pipe cap member (closing member)
152: Upstream conduit
153: Downstream conduit
158: Conduit connection pipe (throttle portion)

The invention claimed is:

1. A silencer for an internal combustion engine, said silencer comprising:

a main body, said main body including an outer tube closed at front and rear ends thereof, wherein an exhaust connection tube to which an exhaust pipe extending from an engine side is connected and a discharge pipe for discharging exhaust gas to the outside therethrough are connected to the outer tube, respectively, and a first partition wall and a second partition wall provided in order from an upstream side in the main body such that an inside of the main body is partitioned into a first chamber and a resonance chamber by the first partition wall and is partitioned into the resonance chamber and a second chamber by the second partition wall, and wherein a conduit is supported on the first partition wall and the second partition wall, wherein the conduit has a downstream end portion configured from a tubular member including a conduit discharge port which extends through the main body and discharges exhaust gas to outside, wherein the tubular member includes a resonance communication hole which communicates with the resonance chamber and an upstream side communication hole and a downstream side communication hole which communicate with the second chamber, and wherein a closing portion which closes an exhaust path at an intermediate location of the tubular member, or a throttle portion which throttles the exhaust path, is provided between the upstream side communication hole and the downstream side communication hole in an inside of the tubular member.

2. The silencer according to claim 1, wherein the resonance communication hole is disposed on an upstream side of the resonance chamber.

3. The silencer according to claim 1, wherein at least part of a circumferential wall of the outer tube which defines the resonance chamber is configured linearly in a longitudinal direction, and wherein a portion of the conduit in the resonance chamber is configured linearly in a longitudinal direction.

4. The silencer according to claim 1, wherein the throttle portion comprising a vertical wall welded in the conduit and includes an opening having a small diameter.

5. The silencer according to claim 1, wherein the throttle portion comprises a pipe member which communicates and connects an upstream conduit which includes the upstream side communication hole and a downstream conduit which includes the downstream side communication hole to each other.

6. The silencer according to claim 1, further comprising a resonance chamber inlet tube attached to the first partition wall, said resonance chamber inlet tube configured to introduce exhaust gas from the first chamber into the resonance chamber and being disposed on the downstream side of the exhaust connection tube, wherein the resonance chamber inlet tube overlaps with the exhaust connection tube as viewed from a direction of an axial line of the exhaust connection tube.

7. The silencer according to claim 1, wherein the discharge pipe includes a closing member provided thereon which closes a front end portion of the discharge pipe disposed in the second chamber, and includes a discharge pipe communication hole perforated therein which communicates the second chamber and the inside of the discharge pipe with each other.

* * * * *